US008535485B2

(12) United States Patent
Cleminson et al.

(10) Patent No.: US 8,535,485 B2
(45) **Date of Patent: *Sep. 17, 2013**

(54) APPARATUS AND PROCESS FOR WET CRUSHING OIL SAND

(75) Inventors: Ron Cleminson, Fort McMurray (CA); David Fudge, Fort McMurray (CA); Michael Carniato, Fort McMurray (CA)

(73) Assignee: Syncrude Canada Ltd., Fort McMurray (CA)

( * ) Notice: Subject to any disclaimer, the term of this patent is extended or adjusted under 35 U.S.C. 154(b) by 794 days.

This patent is subject to a terminal disclaimer.

(21) Appl. No.: 12/614,994

(22) Filed: Nov. 9, 2009

(65) Prior Publication Data

US 2010/0108572 A1 May 6, 2010

Related U.S. Application Data

(63) Continuation-in-part of application No. 12/196,538, filed on Aug. 22, 2008, now Pat. No. 8,388,831, which is a continuation of application No. 10/932,019, filed on Sep. 2, 2004, now Pat. No. 7,431,830.

(60) Provisional application No. 61/112,619, filed on Nov. 7, 2008.

(51) Int. Cl.
*C10G 5/04* (2006.01)

(52) U.S. Cl.
USPC ..... 196/155; 208/390; 208/391; 299/1.05; 299/29; 241/21; 241/29; 241/80

(58) Field of Classification Search
USPC ..... 196/155; 208/390, 391; 299/1.05, 299/29; 241/21, 29, 80
See application file for complete search history.

(56) References Cited

U.S. PATENT DOCUMENTS

| | | | | |
|---|---|---|---|---|
| 5,772,127 | A * | 6/1998 | Maciejewski et al. | 241/21 |
| 5,954,277 | A * | 9/1999 | Maciejewski et al. | 241/21 |
| 6,027,056 | A * | 2/2000 | Maciejewski et al. | 241/62 |
| 6,821,060 | B2 | 11/2004 | McTurk et al. | |
| 7,431,830 | B2 * | 10/2008 | Cleminson et al. | 208/390 |
| 7,651,042 | B2 * | 1/2010 | Bjornson et al. | 241/62 |
| 7,984,866 | B2 * | 7/2011 | Cymerman et al. | 241/79.3 |
| 8,016,216 | B2 * | 9/2011 | Bjornson et al. | 241/21 |

FOREIGN PATENT DOCUMENTS

| | | |
|---|---|---|
| CA | 2195604 | 7/1998 |
| CA | 2332207 | 10/2001 |
| WO | WO 03/056134 | 7/2003 |

* cited by examiner

*Primary Examiner* — Nina Bhat

(74) *Attorney, Agent, or Firm* — Bennett Jones LLP

(57) ABSTRACT

A system for forming an oil sand slurry from mined oil sand is provided, comprising a slurry preparation tower having an intake opening through which oil sand enters the slurry preparation tower, a first sizer device to comminute the oil sand passing through it, a second sizer device to further comminute the oil sand, and a pump box for receiving oil sand that has passed through the second sizer and feeding it to a pump; at least one conveyor, having a discharge end, for transporting mined oil sand to the slurry preparation tower; a metal detector for detecting a piece of metal in the mined oil sand and transmitting a signal; and a metal rejection device operative to, in response to the signal from the metal detector, reject a portion of oil sand containing the piece of metal before the portion of oil sand enters the slurry preparation tower.

16 Claims, 9 Drawing Sheets

APPARATUS AND PROCESS FOR WET CRUSHING OIL SAND

This application is a Continuation-in-Part of U.S. patent application Ser. No. 12/196,538, filed Aug. 22, 2008, which is a Continuation of U.S. patent application Ser. No. 10/932,019, filed Sep. 2, 2004 and now U.S. Pat. No. 7,431,830, issued Oct. 7, 2008, and this application further claims priority to U.S. Provisional Patent Application No. 61/112,619, filed Nov. 7, 2008.

The present invention relates to an apparatus and process for wet crushing oil sand to form a pumpable and pipelinable oil sand slurry without screening.

BACKGROUND OF THE INVENTION

Oil sand containing bitumen mined from the ground is generally slurried with a solvent such as water as part of an initial process for eventually removing the bitumen from the oil sand. Oil sand is a type of bitumen deposit typically containing sand, water and very viscous oil (the bitumen). When the oil sand deposit is located relatively close below the ground surface, the oil sand is often extracted from the deposit by mining. The oil sand is mined by excavating down through the ground surface to where the oil sand deposit occurs and removing oil sand from the deposit with heavy machinery.

Typically, this removal of the oil sand from the deposit is done with some of the largest power shovels and dump trucks in the world, with the power shovels removing shovel-loads of oil sand from the deposit and loading the collected oil sand onto conveyors to be carried away for further processing.

The viscous bitumen tends to hold the sand and water together causing the mined oil sand to contain lumps and chunks, some of which can be quite large. Because of the size of some of these pieces of mined oil sand, the mined oil sand is typically "pre-crushed" by running it through a preliminary crusher to crush the pieces of oil sand to a suitable size for transport on a conveyor (i.e. conveyable size).

The pre-crushed oil sand is then transported by conveyor to a slurry preparation unit as known in the art where the pre-crushed oil sand is further processed to form an oil sand and water slurry.

The slurry preparation unit has to ensure that the pieces of oil sand in the oil sand and water slurry are of pumpable size before the slurry is directed to a pump box and pump to be pumped to the next step in its processing, for example, hydrotransporting the slurry in a pipeline for further conditioning. Therefore, oversize pieces of oil sand or other materials have to be prevented from being directed to the pump in order to obtain a pumpable, pipelinable oil sand slurry. There are at least two forms of slurry preparation units that have been used to form the oil sand and water slurry; slurry preparation units that use screening and more recent screen-less slurry preparation units.

Slurry preparation units that use screening typically comprise a vertically stacked series of components. The pre-crushed oil sand is initially fed into a mixing box where water is mixed with the oil sand to form the slurry. From the mixing box, the oil sand and water slurry is passed through some sort of screening device to remove oversize from the oil sand and water slurry. The slurry that passes through the screening device passes into a pump box where it is pumped to the next stage of the process. The rejected oversize that does not pass through the screening device is rerouted to a crusher to be comminuted and then added to a secondary mix box and again mixed with water to form a slurry before this slurry is passed through another screening device. The portion of the slurry that passes through this other screening device is then returned to the main slurry components. The oversize rejects that do not pass through the second screening device are treated as rejects and removed from the system. The removed rejects are typically eventually hauled away by trucks and dumped in a discard area.

Screening devices commonly used in the industry include fixed screen devices; vibrating screen devices; and rotating screen devices. Fixed screen devices are simply one or more fixed screens that the slurry is pored through. They have the advantage of having a relatively high reliability because they do not have as many moving components as other screening device; however, they have lower efficiencies and tend to have higher rejects rates. Vibrating screens typically have a lower reject rate because the movement of the screens allows more material to pass through, however, because of their motion they tend to have lower reliability. Rotating screens can potentially have higher reliability and efficiency than vibrating screens, however, they are very complex requiring an extensive structure and typically have a lower throughput than vibrating screens.

Slurry preparation units that use screens have a disadvantage in that a portion of the oil sand passing through the slurry preparation units is rejected by the system. This rejection of a portion of the oil sand means that the bitumen in this rejected oil sand is lost, as it is not extracted at later process stages like the rest of the system. In some screening processes, the rejection rate can be as high as 8%. This rejection rate can add up to a significant amount of bitumen that is simply being thrown away. More recently, screen-less slurry preparation towers have been used such as the screen-less system described in U.S. Pat. No. 7,431,830.

Screen-less slurry preparation towers form all of the oil sand and other materials entering the slurry preparation tower into a slurry and as such avoid rejects. In particular, essentially all of the oil sand that enters the tower is typically comminuted in one or more stages to a pumpable size while water is being added to it to form a slurry. This allows bitumen to be extracted from essentially all of the oil sand delivered to the slurry preparation tower, thereby essentially eliminating rejects.

Occasionally, however, there may be instances where tramp metal inclusions in mined oil sand may pose a problem for these screen-less slurry preparation towers. Tramp metal is often a piece of metal from machinery used earlier in the process, such as a piece of shovel tooth from the power shovel or a piece of crusher tooth from the primary crusher. If this piece of tramp metal is large enough, when it is fed into the slurry preparation tower along with a portion of oil sand, the tramp metal may damage or even jam one of the roll crushers used in the slurry preparation tower. This may result in the entire process being stopped while the crusher rolls are either repaired or the jam is located and the tramp metal removed. This may lead to lengthy outages to remove the object from the crusher rolls and affect repairs if any damage has occurred.

The prior art screening processes will typically remove the tramp metal through the screening apparatus, However, with screen-less slurry preparation processes, it may be desirable to remove the tramp metal prior to crushing in the slurry preparation tower to avoid such outages.

SUMMARY OF THE INVENTION

In an aspect, a system for forming an oil sand slurry from mined oil sand is provided, comprising a slurry preparation tower comprising in series an intake opening through which oil sand enters the slurry preparation tower; a first sizer device operative to comminute oil sand passing through the first sizer to a first upper size threshold; a second sizer device operative to comminute oil sand passing through the second sizer to a second upper size threshold, wherein the second upper size threshold is less than the first upper size threshold; and a pump box for receiving oil sand that has passed through the second sizer and feeding it to a pump; at least one conveyor, having a discharge end, for transporting mined oil sand to the slurry preparation tower; a metal detector for detecting a piece of metal in the mined oil sand and transmitting a signal; and a metal rejection device operative to, in response to the signal from the metal detector, reject a portion of oil sand containing the piece of metal before the portion of oil sand enters the slurry preparation tower.

In another aspect, a method of forming a pumpable oil sand slurry is provided comprising the steps of providing at least one conveyor for delivering the mined oil sand to a slurry preparation tower, the slurry preparation tower having a first sizer and a second sizer; monitoring the mined oil sand being delivered by the at least one conveyor for a piece of metal and in response to locating the piece of metal, automatically removing a part of the oil sand containing the piece of metal prior to delivery to the slurry preparation tower; comminuting the oil sand in the first sizer to a first upper size threshold; comminuting the oil sand that has passed through the first sizer in the second sizer to a second upper size threshold that is less than the first upper size threshold; adding a solvent to the oil sand as it passes through the slurry processing tower; and pumping formed oil sand slurry out of the slurry preparation tower; whereby substantially all of the oil sand entering the slurry preparation tower exists the slurry preparation tower as oil sand slurry.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventors. The detailed description includes specific details for the purpose of providing a comprehensive understanding of the present invention. However, it will be apparent to those skilled in the art that the present invention may be practiced without these specific details.

Figure 1:
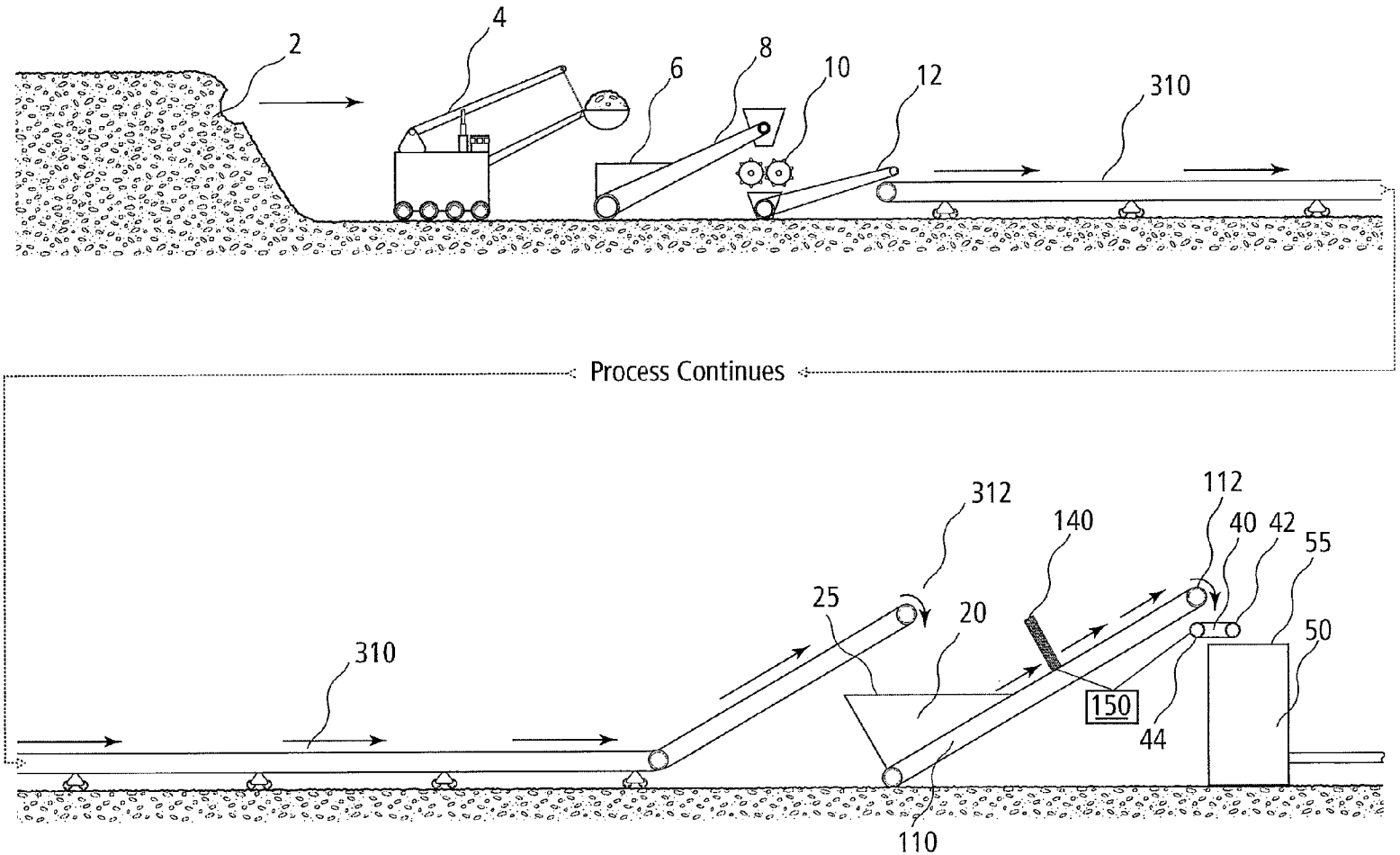
FIG. 1 is a schematic illustration of a process for forming a pumpable oils and water slurry.

FIG. 1 illustrates a process wherein oil sand is mined then processed to form an oil sand slurry ready for hydrotransport (pumpable oil sand slurry). Oil sand mined from an oil sand deposit 2 by a power shovel 4 is fed into a hopper 6 of a preliminary conveyor 8. The preliminary conveyor 8 deposits a flow of the mined oil sand into a preliminary (or primary) crusher 10 that reduces the size of the mined oil sand to pieces of conveyable size (pre-crushed oil sand). From the preliminary crusher 10 the pre-crushed oil sand is fed to a transport conveyor 310, using a loading conveyor 12, where the particulate oil sand is transported along the transport conveyor 310 to a discharge end 312 of the transport conveyor 310. At the discharge end 312 of the transport conveyor 310, the pre-crushed oil sand is discharged through an intake opening 25 of a surge bin 20, where it is eventually carried up a conveyor 110 and discharged into an intake opening 55 of the slurry preparation tower 50. The slurry preparation tower 50 takes the flow of particulate oil sand discharging from a discharge end 112 of the conveyor 110 and processes the flow of particulate oil sand to form a pumpable oil sand slurry.

Figure 2:
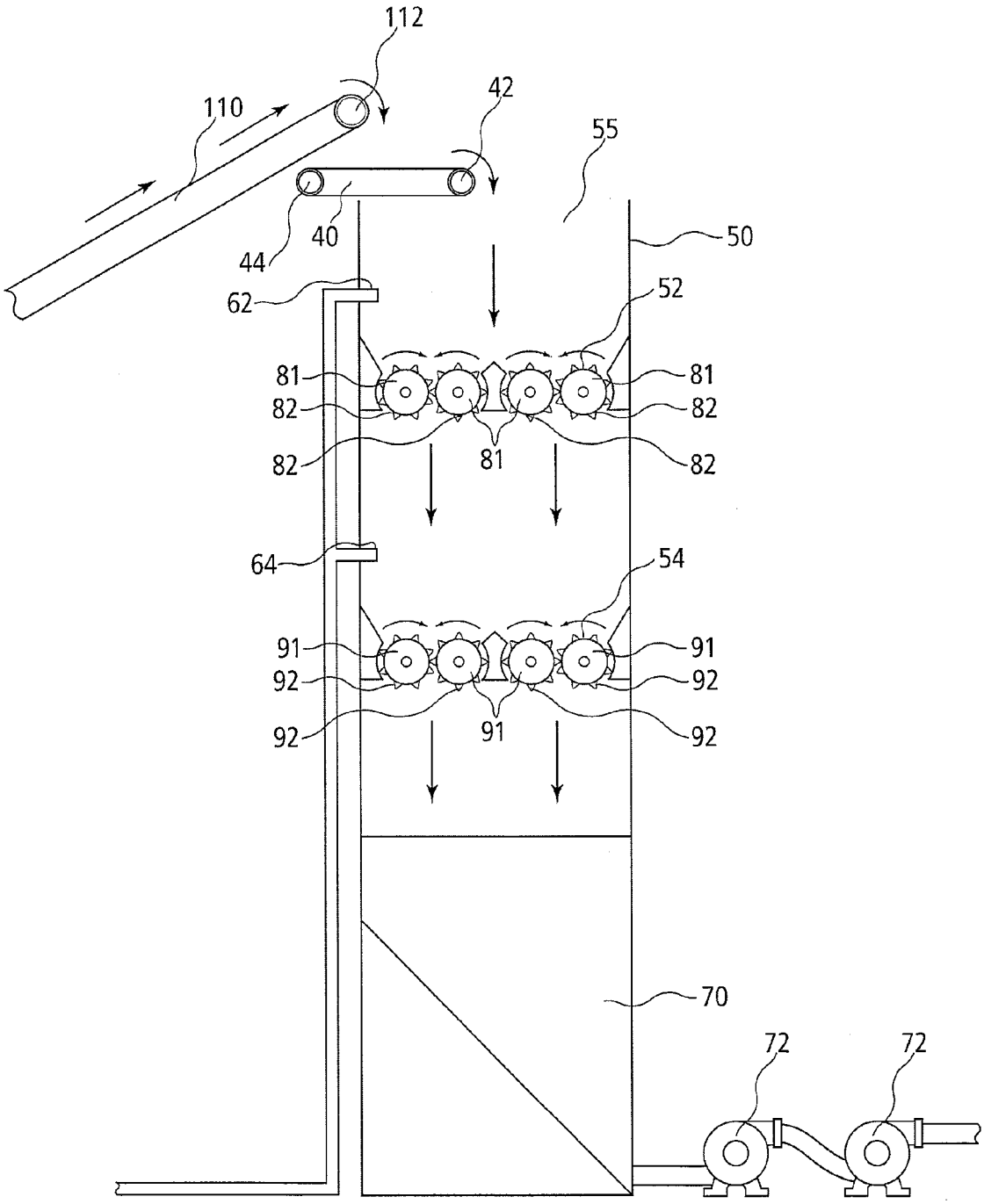
FIG. 2 is a schematic illustration of the internal stages is a slurry preparation tower to form an oil sand and water slurry.

FIG. 2 is a schematic illustration of the internal components of the slurry preparation tower 50 used to form the oil sand into an oil sand and water slurry where the oil sand in the oil sand and water slurry is of pumpable size.

An apron feeder 40 is positioned below the discharge end 112 of the conveyor 110 with a first end 42 of the apron feeder 40 positioned over an intake opening 55 in the slurry preparation tower 50.

The slurry preparation tower 50 has two comminuting stages implement with a first sizer 52 and a second sizer 54.

The first sizer 52 is positioned below the first end 42 of the apron feeder 40 so that oil sand discharging off the first end 42 of the apron feeder 40 can drop directly downwards onto the first sizer 52. The first sizer 52 comminutes the oil sand passing through the first sizer 52 to a first upper threshold size so that substantially all the pieces of oil sand that have passed through the first sizer 52 are no greater in size than the first upper threshold size. In one aspect, this first upper threshold size is approximately eight (8) inches so that substantially all of the pieces of oil sand that have passed through the secondary sizer 52 are eight (8) inches in size or less.

In one aspect, the first sizer 52 can include four (4) rotatable elements in the form of crusher rolls 81 having a generally cylindrical shape and positioned side-by-side, however, it is understood that any type of mineral sizer that is known in the art could be used for the first sizer 52. Each of the crusher rolls 81 have a plurality of crusher teeth 82 to aid in comminuting large pieces of oil sand. The crusher rolls 81 are spaced a set horizontal distance apart to form gaps between adjacent crusher rolls 81. The size of the gaps determines the first upper size threshold the secondary sizer 52 will size oil sand passing through the first sizer 52 to.

The second sizer 54 comminutes the oil sand passing through the second sizer 54 to a second upper threshold size. The second upper threshold size is smaller than the first upper threshold size. In this manner, the second sizer 54 reduces the size of the larger pieces of oil sand even more than the first sizer 52. In one aspect, this second upper threshold size is approximately four (4) inches so that substantially all of the pieces of oil sand that have passed through the second sizer 52 are four (4) inches in size or less.

In one aspect, the second sizer 54 can include four (4) rotatable elements in the form of crusher rolls 91 positioned side-by-side, however, as previously mentioned, any type of mineral sizer known in the art could be used for the second sizer 54. Each of the crusher rolls 91 have a plurality of crusher teeth 92 to aid in comminuting large pieces of oil sand. However, the gaps between adjacent crusher rolls 91 are smaller than the gaps between adjacent crusher rolls 81 of the first sizer 52, so that the second sizer 54 comminutes material to a smaller size than the first sizer 54. Additionally, the crusher teeth 92 on the crusher rolls 91 may be smaller and there may be more crusher teeth 92 on a crusher roll 91 than the number of crusher teeth 82 on the crusher rolls 81 of the first sizer 52.

The second sizer 54 can be positioned directly below the first sizer 52 so that substantially all of the oil sand passing through the first sizer 52 drops unimpeded onto the second sizer 54.

A first liquid outlet 62 is provided above the first sizer 52 so that a solvent, such as water, can be added to the oil sand as it falls onto the first sizer 52. A second liquid outlet 64 is provided above the second sizer 54 but below the first sizer 52 so that a solvent, such as water, can be added to the oil sand passing out of the first sizer 52 as it drops to the second sizer 54. In one aspect, each outlet can comprise one or more nozzles.

A pump box 70 is provided below the second sizer 54 so that oil sand that has passed through the second sizer 54 drops into the pump box 70, where it can be pumped by one or more pumps 72 to the next stage in the process.

In operation, oil sand is discharged from the discharge end 112 of the conveyor 110 and onto the apron feeder 40. In normal operation, the apron feeder 40 discharges the oil sand from the first end 42 of the apron feeder 40 through the intake opening 55 and drops it downwards towards the first sizer 52. As the oil sand falls towards the first sizer 52, a solvent, such as water, can be sprayed onto the falling oils sand using the first liquid outlet 62, wetting the falling oil sand that contacts the first sizer 52.

When the oil sand reaches the first sizer 52, the oil sand is comminuted as it passes through the first sizer 52 to a size equal to or smaller than the first upper size threshold before the oil sand exits the first sizer 52 and drops towards the second sizer 54.

Oil sand that has passed through the first sizer 52 falls downwards towards the second sizer 54. As the oil sand falls towards the second sizer 54, a solvent, such as water, can be sprayed onto the falling oils sand using the second liquid outlet 64, wetting the falling oil sand that contacts the second sizer 54.

The second sizer 54 comminutes the oil sand to a size equal to or smaller than the second upper size threshold before allowing the oil sand to pass through the second sizer 54.

Oils sand that has passed through the second sizer 54 drops into the pump box 70 positioned below the second sizer 54 where the oil sand and water slurry will be pumped by the one or more pumps 72 to the next stage of the bitumen extraction process for further processing.

In this manner, substantially all of the oil sand that is introduced into the slurry preparation tower 50 through the intake opening 55, exits the slurry preparation tower in an oil sand and water slurry to be transported to the next stage in its processing. All of the oil sand in the slurry has been reduced to a pumpable size and none of the oil sand is rejected from the slurry preparation tower to be hauled away and discarded.

Figure 3:
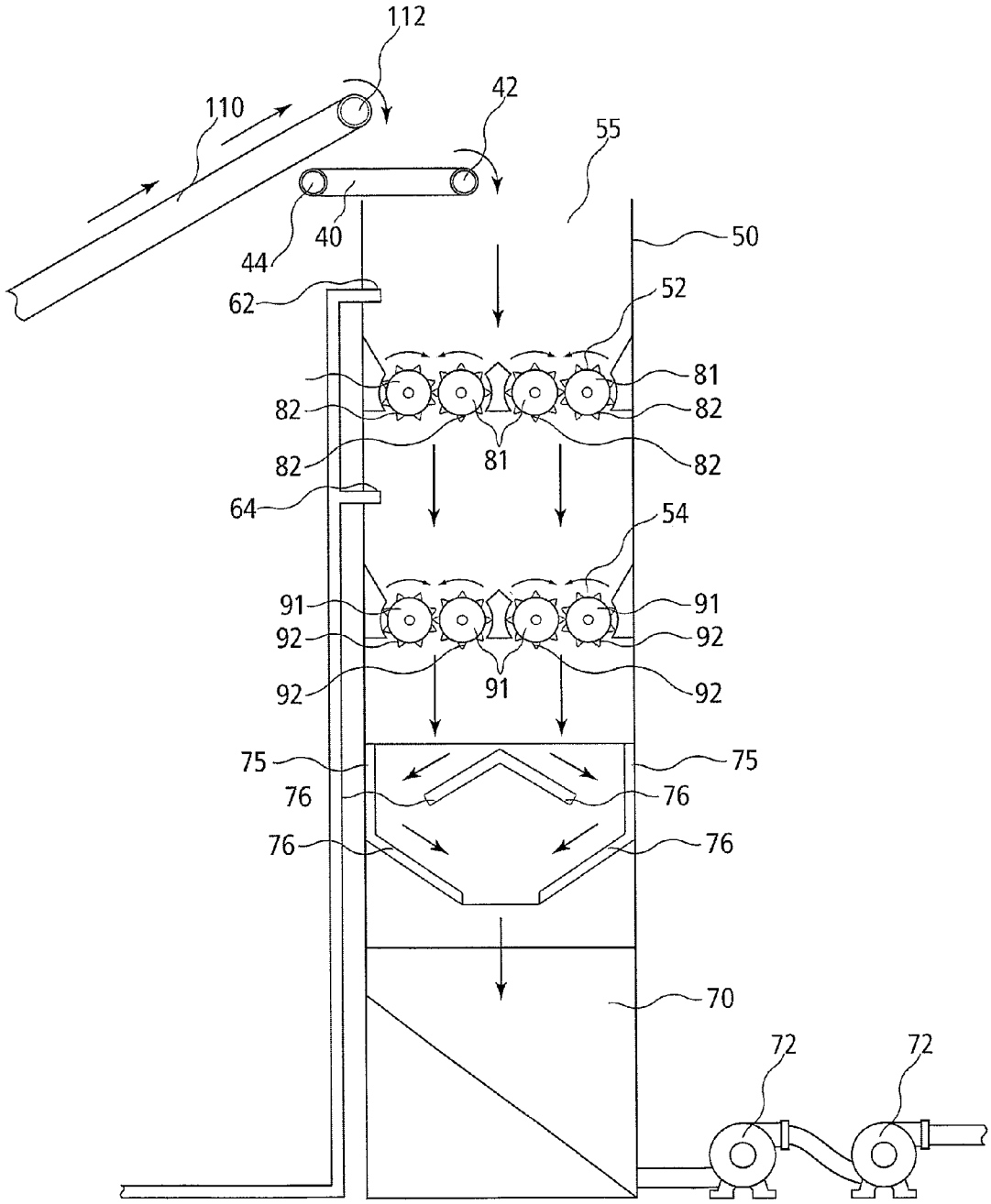
FIG. 3 is a schematic illustration of a variation of a slurry preparation tower using a mixing box.

FIG. 3 is a schematic illustration of a further aspect of the internal components of the slurry preparation tower 50 where a mixing box 75 is provided. A number of overlapping, downwardly inclined, descending shelves 76 are provided in the mixing box 76 to mix the oil sand and water slurry as it passes through the mixing box 75 before entering the pump box 70.

In the slurry preparation tower 50 shown in FIG. 2 and FIG. 3, substantially all of the oil sand that is introduced into the slurry preparation tower 50 through the intake opening 55, is formed into a slurry and exits the slurry preparation tower as this slurry to be pumped to the next stage in its processing. All of the oil sand in the slurry has been reduced to a pumpable size and none of the oil sand is rejected from the slurry preparation tower to be hauled away and discarded.

Because all of the oil sand and any other materials that enter the slurry preparation tower pass through the first sizer device 52 and second sizer device 54, it may at times be beneficial to detect pieces of metal in the oil sand that is being transported to the slurry preparation tower 50 and remove the detected pieces of metal before the pieces or metal are delivered to the slurry preparation tower 50.

Figure 4:
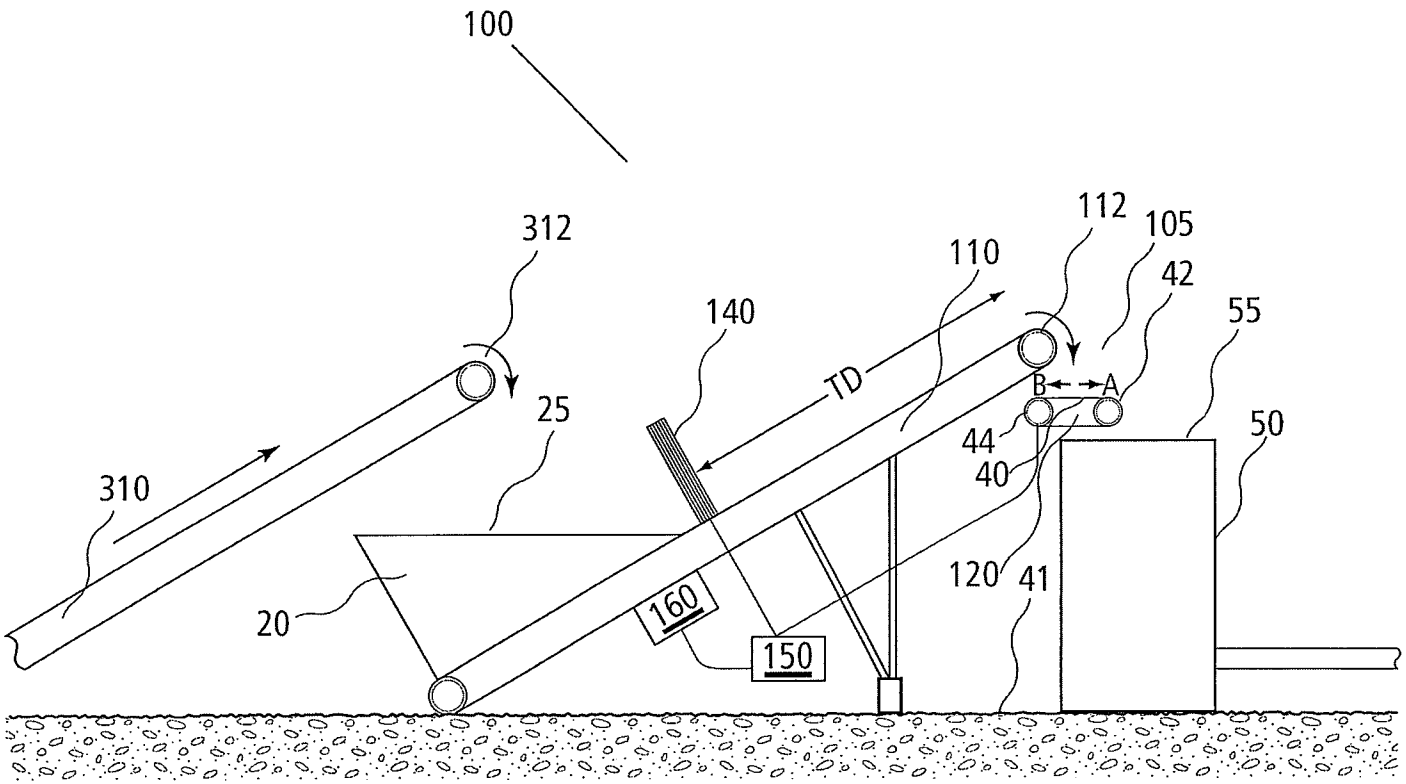
FIG. 4 is a schematic illustration of a system, in a first aspect, for detecting a piece of metal in particulate oil sand being carried along a conveyor and rejecting a portion of the particulate oil sand containing the piece of metal.

FIG. 4 is a schematic illustration of a system 100 in a first aspect. The system 100 supplies a flow of particulate oil sand to the slurry preparation tower 50, where the oil sand will be further crushed and slurried with water to form a pumpable oil sand slurry for further processing. The system 100 comprises: a first conveyor 110; a redirecting device 105 including the apron feeder 40; a metal detector 140; and a control device 150.

The first conveyor 110 transports a flow of particulate oil sand along a length of the first conveyor 110 towards a discharge end 112 of the first conveyor 110. The discharge end 112 is provided generally above an intake opening 55 of the slurry preparation tower 50.

The redirection device 105 includes the apron feeder 40. The apron feeder 40 is provided below the discharge end 112 so that a flow of particulate oil sand being discharged from the discharge end 112 of the first conveyor 110 lands on the apron feeder 40. The apron feeder 40 is bi-directional so that the second conveyor 120 can be driven to carry material along the apron feeder 40 either in a first direction, A, or a second direction, B. The apron feeder 40 is positioned so that particulate oil sand moved by the apron feeder 40 in the first direction, A, and discharged from a first end 42 of the apron feeder 40 will drop into the intake opening 55 of the slurry preparation tower 50. A second end 44 of the apron feeder 40 is positioned so that particulate oil sand moved by the apron feeder 40 in the second direction, B, and discharged from the second end 44 of the second conveyor 120 will not fall into the intake opening 55 of the slurry preparation tower 50. In an aspect, the second end 44 of the apron feeder 40 is positioned so that oil sand discharged off of the second end 44 of the apron feeder 40 falls to a ground surface, 41, beside the slurry preparation tower 50.

The metal detector 140 is positioned along the first conveyor 110 a travel distance, TD, from the discharge end 112 of the first conveyor 110. The metal detector 140 can detect a piece of metal in the flow of particulate oil sand traveling along the first conveyor 110 past the metal detector 140.

Figure 5:
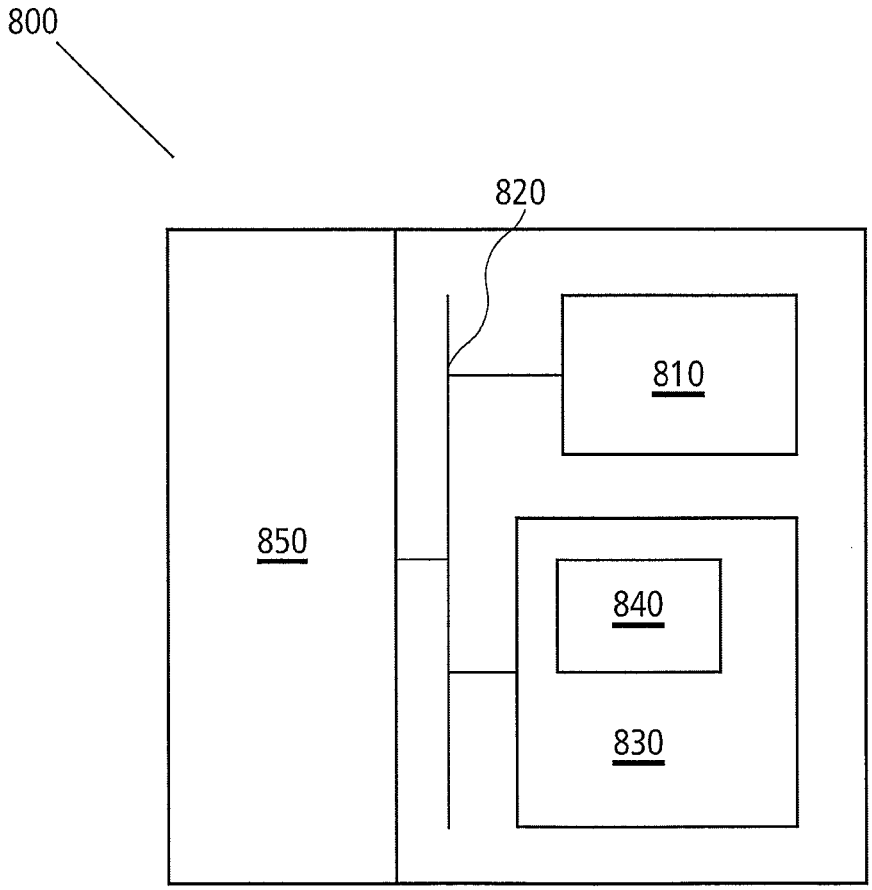
FIG. 5 is a schematic illustration of a data processing system for use as a controller in one aspect.

The controller 150 is operatively connected to the metal detector 140 and the apron feeder 40. The controller 150 could be a computer, a programmable logic controller (PLC), etc. operative to receive and transmit signals to control the operation of the system 100, such as the data processing device 800 shown in FIG. 5. The data processing device 800 includes a processor 810, system buses 820, memory 830 containing program instructions 840 and an I/O interface 850. The processor 810 is a central processing unit that is typically microprocessor based to implement the program instructions 840 and control the operation of the data processing device 800. The system buses 820 allow the transmissions of digital signals between the various components of the data processing device 800. The memory 830 stores the operating system, data needed for the operation of the data processing device and the program instructions 840. Typically, the memory 830 will contain RAM for data and an EPROM or Rom for storing the operating system and program instructions 840. The I/O interface 850 allows for the connection to remote components to receive signals from remote components and transmit signals to the remote components. A person skilled in the art will appreciate that the data processing system 800 will also include components, such as a power supply, in addition to those illustrated in FIG. 5.

Referring again to FIG. 4, the controller 150 is operatively connected to the metal detector 140 so that the controller 150 can receive a metal detected signal from the metal detector 140 when the metal detector 140 detects a piece of metal in the flow of particulate oil sand traveling along the first conveyor 110. The controller 150 is operatively connected to the apron feeder 40 so that the controller 150 can control the direction of the apron feeder 40. In an aspect, the controller 150 is operatively connected to a speed sensing device 160, such as a pulley mounted speed encoder, to obtain a speed of the first conveyor 110.

Figure 6:
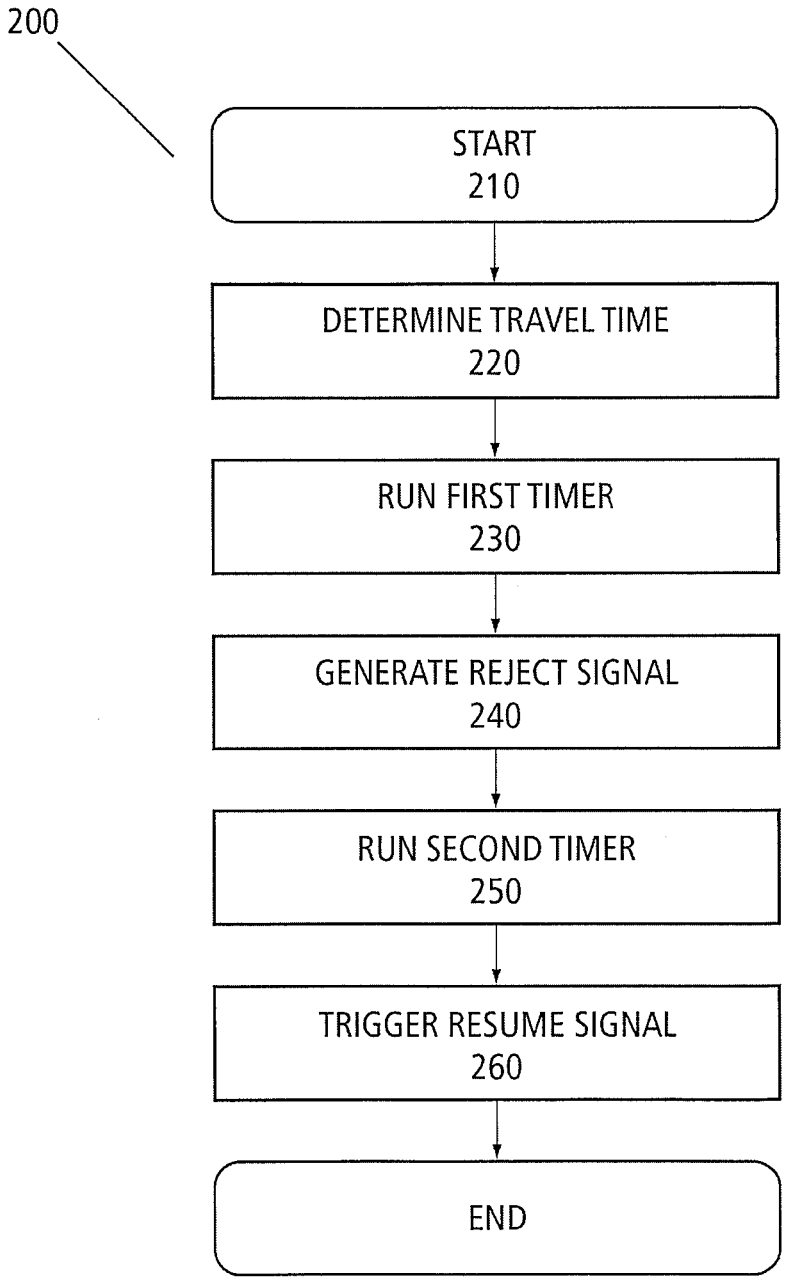
FIG. 6 is a flowchart illustrating a method followed by the controller of FIG. 5 to activate a metal rejection device in response to a signal that metal has been detected.

FIG. 6 is a flowchart illustrating a method 200 used by the controller 150, in FIG. 2, to control the system 100. The method 200 comprises the steps of: determining a travel time 220; running a first timer 230; generating a reject signal 240; running a second timer 250; and triggering a resume signal 260.

Referring to FIGS. 4 and 6, method 200 is started at step 210 when the controller 150 receives a metal detected signal from the metal detector 140, indicating that a piece of metal has been detected in the flow of particulate oil sand traveling along the first conveyor 110.

At step 220, a travel time for the piece of metal detected by the metal detector 140 to reach the discharge end 112 is determined. The travel time is determined based on the travel distance, TD, of the metal detector 140 from the discharge end 112 of the first conveyor 110 and the operating speed of the first conveyor 110. The travel distance, TD, provides the distance the piece of metal will have to travel after it has passed the metal detector 140 before it reaches the discharge end 112 of the first conveyor 110. The operating speed of the first conveyor 110 indicates the speed at which the metal object and the oil sand are being carried along the first conveyor 110. The operating speed of the first conveyor 110 could be obtained by the controller 150 by having the first conveyor 110 maintain a constant operating speed, however, because the travel distance, TD, can be quite long and the travel time relatively long (more than a minute) it might be desirable to obtain the operating speed of the conveyor belt 110 directly from the speed sensing device, 160, or from a device controlling the speed of the first conveyor belt 110.

At step 230, the method 200 runs a first timer for a period of time equal to the travel time minus a buffer time.

At step 240, after the first timer has been run, a reject signal is generated from the controller 150 to the apron feeder 40. Step 240 is performed by the controller 150 after the first timer is run. The first timer runs for a period of time equal to the travel time determined at step 220, for the piece of metal to reach the discharge end 112 of the first conveyor 110 less a buffer time. The buffer time is a short period of time used so that a reject signal is generated by the controller 150, at step 240, before the piece of metal is discharged from the discharge end 112 of the first conveyor 110. The buffer time can allow enough time for the direction of operation of the apron feeder 40 to be reversed before the particulate oil sand containing the piece of metal falls onto the apron feeder 40, so that the apron feeder 40 is already operating in the second direction, B, by the time the piece of metal lands on the apron feeder 40. The buffer time can also be used to account for inaccuracies in the travel time determined at step 220 and delays in the transmission of the reject signal by increasing the buffer timer to have the reject signal transmitted earlier.

The travel time is use to determine when the piece of metal detected by the metal detector 140 has traveled along the first conveyor 110 to the discharge end 112 of the first conveyor 110. Before the piece of metal is discharged off the discharge end 112 of the first conveyor 110, the controller 150 transmits the reject signal to the apron feeder 40.

When the apron feeder 40 receives the reject signal from the controller 150, the apron feeder 40 reverses its direction of travel, moving material on the apron feeder 40 in the direction, B, carrying particulate oil sand discharged onto the apron feeder 40, from the first conveyor 110, off the second end 44 of the apron feeder 40 so that the oil sand does not fall into the intake opening 55 of the slurry preparation tower 50 and into the number of crusher rolls (not shown) contained in the slurry preparation tower 50.

At step 250, a second timer is run for a discharge time. The discharge time will be based on the length of the apron feeder 40 and the time required for particulate material landing on the apron feeder 40 from the first conveyor 110 to be carried off the second end 44 of the apron feeder 40 and how quickly the direction of operation of the apron feeder 40 can be reversed. Typically, this time is less than one (1) minute with times of ten (10) seconds or less being possible to reduce the time the flow of particulate oil sand is stopped.

After the second timer has run for the discharge time, the method 200 proceeds to step 260 and a resume signal is transmitted. The controller 150 generates a resume signal and transmits it to the apron feeder 40 causing the apron feeder 40 to once again change the direction and resume normal operation. The apron feeder 40 reverses the direction of travel from the second direction, B, back to the first direction, A, causing particulate oil sand discharged from the first conveyor 110 onto apron feeder 40 to once again be discharged off the first end 42 of the apron feeder 40 and into the intake opening 55 of the slurry preparation tower 50.

With step 260 completed, the system 100 is once again operating under normal conditions delivering a flow of particulate oil sand to the slurry preparation tower 50 and the method 200 ends.

The method 200 will be invoked again if the metal detector 140 determines that there is another piece of metal in the particulate oil sand traveling along the first conveyor 110.

In this manner, when the system 100 detects a piece of metal in the oil sand traveling along the first conveyor 110, the system 100 approximates when the piece of metal will reach the discharge end 112 of the first conveyor 110 and be discharged from the first conveyor 110. Shortly before the piece of metal is discharged off the first conveyor 110, the direction of travel of the apron feeder 40 is reversed so that particulate oil sand on the apron feeder 40 is rejected from the system 100 by the apron feeder 40. The reversal of direction of the apron feeder 40 discharges a portion of particulate oil sand off the second end 44 of the apron feeder 40, preventing the portion of particulate oil sand from entering the slurry preparation tower 50. During this time, the piece of metal is discharged off the discharge end 112 of the first conveyor 110, onto the second conveyor 120, where it is rejected from the system. After a relatively short period of time, sufficient for the portion of particulate oil sand containing the piece of metal to be discharged off the apron feeder 40, the direction of the apron feeder 40 is once again reversed and oil sand discharged from the first conveyor 110 to the apron feeder 40 is once again fed into the intake opening 55 of the slurry preparation tower 50.

Although a portion of the oil sand is rejected along with the piece of metal, the amount of time the flow of oil sand entering the slurry preparation tower 50 is halted is relatively short, only the short period of time for the piece of metal to be discharged off the end of the first conveyor 110 onto the apron feeder 40, and then discharged off the second end 44 of the apron feeder 40. This short period of time is based on the length of the apron feeder 40. The shorter the apron feeder 40 and the faster the apron feeder 40 can change its direction of operation, the shorter the short period of time can be.

Because only the operation of the apron feeder 40 is affected, the first conveyor 110 can be operated at a constant speed of operation throughout the operation of the method 200. Stopping the first conveyor 110 or even altering the speed of first conveyor 110 requires significantly more force and time than stopping or altering the direction of motion of the apron feeder 40 because of the greater inertia of the moving much larger conveyor belt of the first conveyor 110. Once the first conveyor 110 is stopped, significant force is also required to get the first conveyor 110 back up to operating speed. This can significantly impact the slurrying of the oil sand, because the slurry preparation is a continuous process. This continuous process is affected by the slowing down of the first conveyor 110 because this alters the flow rate of particulate oil sand entering the slurry preparation tower 50, which can result in variations in density of the resulting oil sand slurry. The process is also interrupted for the duration of the time the first conveyor 110 is stopped because there is no particulate oil sand entering the slurry preparation tower 50 while the first conveyor 110 has stopped operating. Finally, starting the first conveyor 110 up again, after the interruption, requires the first conveyor 110 to be accelerated back up to operating speed, which again requires some time, resulting in an uneven flow rate of particulate oil sand entering the slurry preparation tower 50 during this period, until the first conveyor 110 once again achieves operating speed.

Because the apron feeder 40 is significantly shorter than the first conveyor 110, altering the speed of the apron feeder 40 is much easier, requiring much less force and time than the first conveyor 110 to bring the apron feeder 40 up to operating speed. Because the first conveyor 110 can be operated at a constant operating speed while the direction of the apron feeder 40 is reversed, the flow rate of particulate oil sand being discharged from the first conveyor 110 onto the apron feeder 40 remains constant, resulting in a more constant flow rate of particulate oil sand being delivered to the slurry preparation tower 50.

Figure 7:
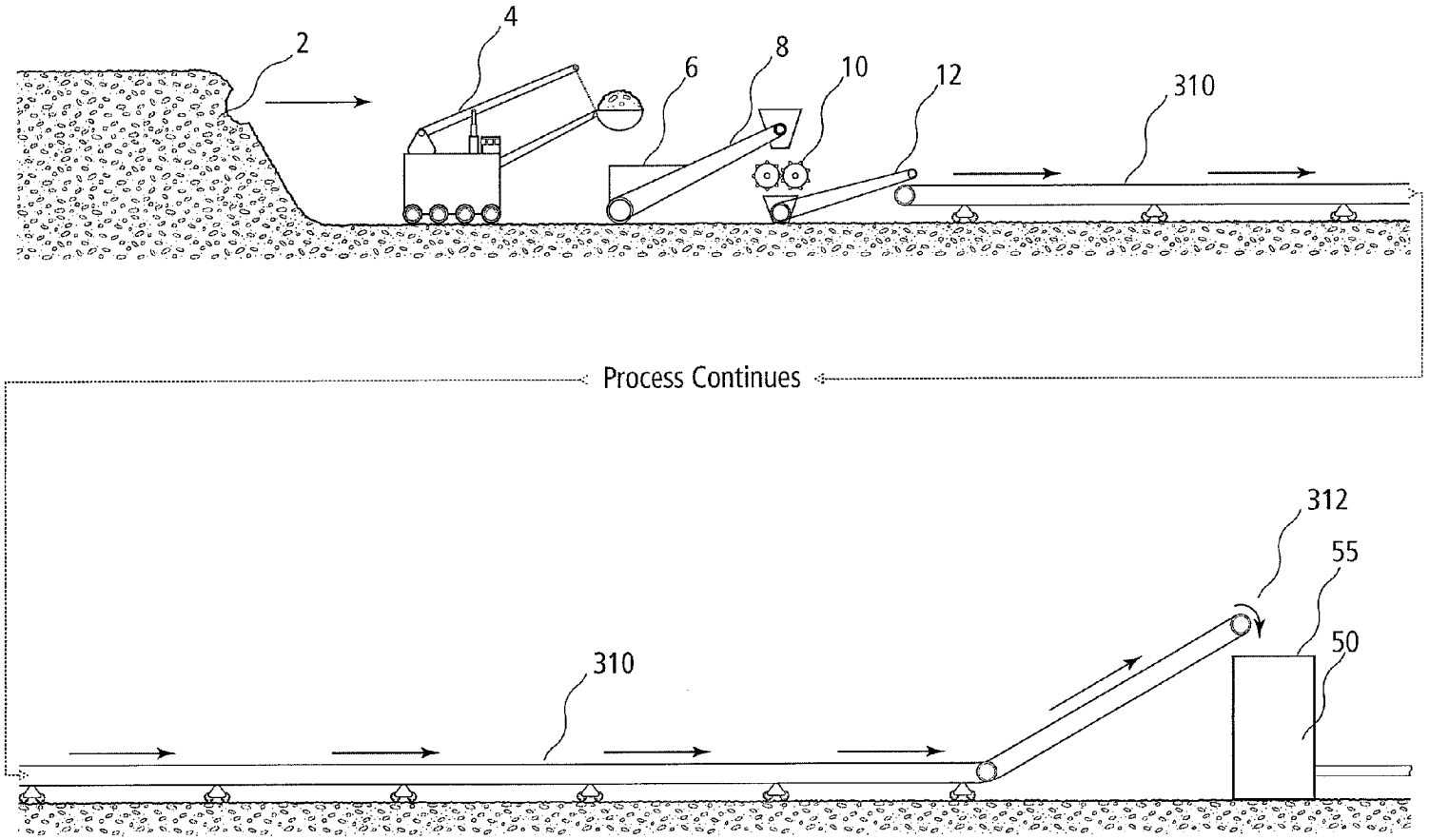
FIG. 7 is a schematic illustration of a process for forming a pumpable oil sand and water slurry wherein a surge bin is not used.

In some aspects, the surge bin 20 may not be used. FIG. 7 is a schematic illustration of a variation of a process for taking mined oil sand and forming an oil sand slurry from the mined oil sand. This process is similar to the process shown in FIG. 1, with the exception that the surge bin 20 and the conveyor 110 are not used. Instead, the transport conveyor 310 discharges directly into the intake opening 55 of the slurry preparation tower 50. The system 100 shown in FIG. 7 can be used with the transport conveyor 310, when the transport conveyor 310 is discharging directly into the slurry preparation tower 50. The metal detector 140 can be placed at a point along the length of the transport conveyor 310.

With the transport conveyor 310 discharging directly into the slurry preparation tower 50, the difference in size between the transport conveyor 310 and the second conveyor 120 is even greater. The transport conveyor 310 may be quite long in aspects where it has to carry particulate oil sand from a preliminary crushing stage to the slurry preparation tower 50, while the second conveyor 120 is much shorter than the transport conveyor 310. In some instances, the transport conveyor 310 can be five hundred (500) meters long or more, requiring more than a kilometer of conveyor belt. Because of this, the forces required to slow down and stop the transport conveyor 310 are much greater than those required to alter the direction of motion of the second conveyor 120. Additionally, to once again get the transport conveyor 310 up to a desired operating speed after the transport conveyor 310 is stopped, significant force and time is required to accelerate the transport conveyor 310 back to the desired operating speed. These variations in speed and stopping time can significantly affect the slurrying process.

Figure 8:
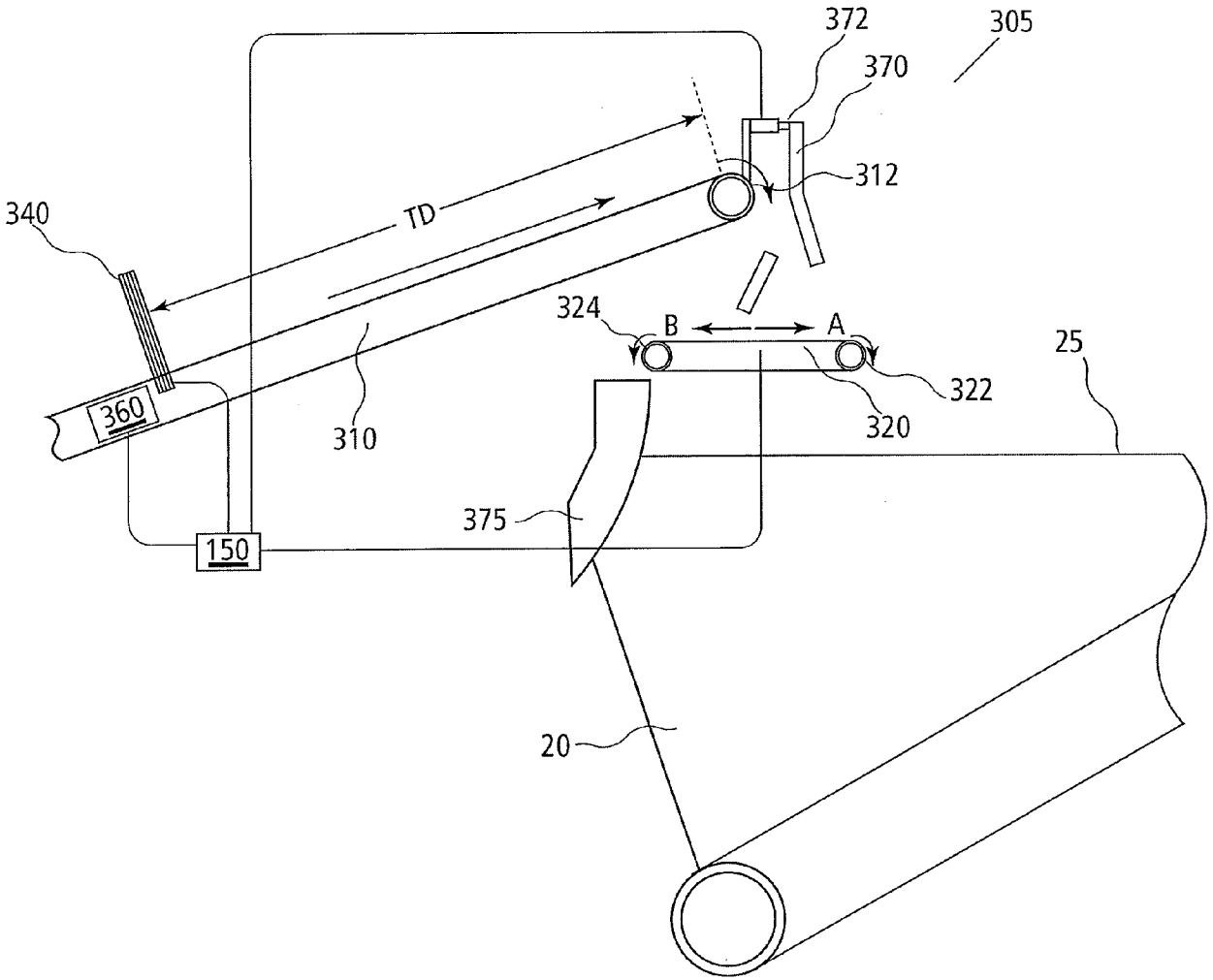
FIG. 8 is a schematic illustration of a system, in a further aspect, for detecting a piece of metal in particulate oil sand carried along a conveyor and rejecting a portion of the particulate oil sand containing the piece of metal, using a baffle wall.
Figure 9:
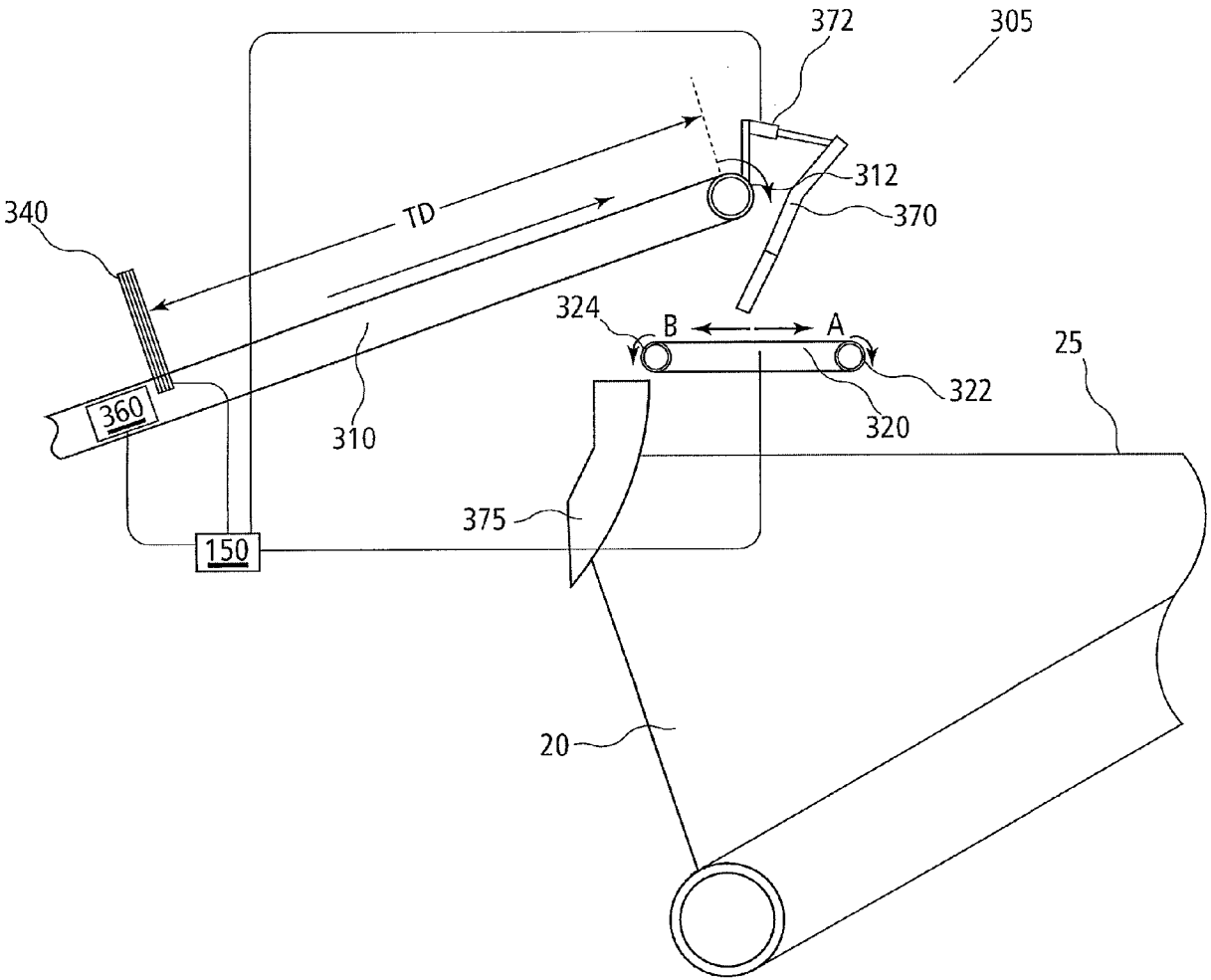
FIG. 9 is a schematic illustration of a data processing system for use as a controller in one aspect.

Referring again to FIG. 1, even when the surge bin 20 and the conveyor 110 are used, in some cases it may be desirable to reject a piece of metal from the transport conveyor 310, rather than the conveyor 110. FIGS. 8 and 9 are schematic illustrations of a system 300 in a further aspect. Because the conveyor 310 does not discharge directly into the slurry preparation tower 50, but rather into the surge bin 20, system 300 has to be modified from system 100, shown in FIG. 4 to take into account this difference. The system 300 comprises: a first conveyor 310; a redirection device 305, including a second conveyor 320 and a baffle wall 370; a chute 375; a metal detector 340; and a controller 150.

The first conveyor 310 has a discharge end 312. Particulate oil sand traveling along the first conveyor 310 is discharged from the first conveyor 310 at the discharge end 312 of the first conveyor 310.

The redirection device 305 is provided at the discharge end 312 of the conveyor 310. The second conveyor 320 is positioned below the discharge end 312 of the first conveyor 310. The second conveyor 320 is bi-directional so that it can be operated in a first direction, A, or a second direction, B. A first end 322 of the second conveyor 320 is positioned so that material discharged from the first end 322 of the second conveyor 320, when the second conveyor 320 is operating in the first direction, A, falls into the intake opening 25 of the surge bin 20. The second end 324 of the second conveyor 320 is positioned so that material discharged from the second end 324 of the second conveyor 320 is discharged to the chute 375 and the chute 375 directs the material away from the intake opening 25 of the surge bin 20.

The baffle wall 370 is positioned relative to the discharge end 312 and can be moved between a first position and a second position. In the first position, as shown in FIG. 8, the baffle wall 370 allows particulate oil sand being discharged from the discharge end 312 of the first conveyor 310 to fall into the intake opening 25 of the surge bin 20, with any of the particulate oil sand falling on the second conveyor 320 being carried in the first direction, A, by the second conveyor 320, until the particulate oil sand is discharged off the first end 322 of the second conveyor 320 into the intake opening 25 of the surge bin 20. With the baffle wall 370 placed in the second position, as shown in FIG. 9, the baffle wall 370 deflects all of the particulate oil sand discharging from the discharge end 312 of the first conveyor 310 towards the second conveyor 320.

Typically, a hydraulic cylinder 372 is used to move the baffle wall 370 between the first position and the second position.

The metal detector 340 is positioned a travel distance, TD, upstream from the discharge end 312 of the first conveyor 310. The metal detector 340 can detect a piece of metal passing by the metal detector on the first conveyor 310.

The controller 150 is operatively connected to the metal detector 340, the baffle wall 370 (specifically the hydraulic cylinder 372), the second conveyor 320 and optionally a speed determining device 360.

The controller 150 could be a computer, programmable logic controller, etc. operative to control the operation of the system 300. The controller 150 is operatively connected to the metal detector 340 to receive metal detected signals from the metal detector 340 when the metal detector 340 detects a piece of metal passing the metal detector 340 on the first conveyor 310. The controller 150 is operatively connected to the hydraulic cylinder 372 and the second conveyor 320 so that the controller 150 can transmit reject signals and resume signals to the hydraulic cylinder 372 and the second conveyor 320.

In response to receiving a reject signal from the controller 150, the second conveyor 320 reverses its direction of operation from the first direction, A, with the second conveyor 320 discharging into the intake opening 25 of the surge bin 20, to the second direction, B and the hydraulic cylinder 372 moves the baffle wall 370 from the first position (shown in FIG. 8) to the second position (shown in FIG. 9). In this manner, particulate oil sand discharging from the first conveyor 310 is directed away from the intake opening 25 of the surge bin 20, so that a portion of the particulate oil sand is prevented from entering the surge bin 20 and continuing through the process.

In response to receive a resume signal, the second conveyor 320 reverses its direction of operation back to the first direction, A, and the hydraulic cylinder 372 moves the baffle wall 370 back to the first position (shown in FIG. 8) and the system 300 resumes normal operation, continuing to transport a flow of particulate oil sand to the slurry preparation tower 50.

Referring to FIGS. 6, 8 and 9, the controller 150 uses the method 200 illustrated in FIG. 3 to control the operation of the system 300 when a piece of metal is detected by the metal detector 340.

Method 200 begins at step 210 when controller 150 receives a metal detected signal from the metal detector 340. At step 220, the controller 150 determines a travel time for the piece of metal to travel the travel distance, TD, along the first conveyor 310 from the metal detector 340 to the discharge end 312.

Using the travel time determined at step 220, the controller 150 runs a first timer for a timer period equal to the travel time minus a buffer time. When the first timer ends, a reject signal is generated and transmitted to the hydraulic cylinder 372 and the second conveyor 320 at step 240.

Upon receiving the reject signal from the controller 150, the hydraulic cylinder 372 is activated, moving the baffle wall 370 from the first position (as shown in FIG. 8) to the second position (as shown in FIG. 9). With the baffle wall 370 moved to the second position, particulate oil sand discharging from the discharge end 312 of the first conveyor 310 is deflected to the second conveyor 320. When the second conveyor 320 receives the reject signal transmitted by the controller 150, the direction of operation of the second conveyor 320 is reversed from the first direction, A, to the second direction, B, causing particulate matter landing on the second conveyor 320 to be moved in the second direction, B, and off the second end 324 of the second conveyor 320 into the chute 375.

After step 240, any particulate oil sand discharged from the discharge end 312 of the first conveyor 310 is deflected by the baffle wall 370 to the second conveyor 320. Once on the second conveyor 320, the oil sand is carried to the second end 324 of the second conveyor 320 where the chute 375 directs the particulate oil sand away from the intake opening 25 of the surge bin 20. In this manner, the system 300 temporarily directs a portion of the particulate oil sand flow being discharged from the discharge end 312 of the first conveyor 310 away from the intake opening 25 of the surge bin 20, removing this portion of oil sand containing a piece of metal from the process of creating an oil sand slurry and preventing the piece of metal contained within the portion of particulate oil sand flow from carrying on through later steps in the process.

At step 240, the controller 150 runs a second timer for a discharge time and after the second timer has run for the discharge time, step 250 is performed and a resume signal transmitted by the controller 150 to the hydraulic cylinder 372 and the second conveyor 320. Upon receiving the resume signal, the hydraulic cylinder 372 moves the baffle wall 370 from the second position (as show in FIG. 9), where the baffle wall 370 is deflecting the particulate matter discharging from the discharge end 312 of the first conveyor 310 towards the second conveyor 320, back to the first position (as shown in FIG. 8. The resume signal also causes the direction of operation of the second conveyor 320 to be once again reversed so that the direction of operation of the second conveyor 320 is once again in the first direction, A. With the baffle wall 370 back in the first position and the second conveyor 320 moving in the first direction, A, the system 300 is back operating in a normal fashion and oil sand discharged from the first conveyor 310 is eventually moved through the process to be contained in an oil sand slurry. After step 260, method 200 ends.

In this manner, system 300 allows a portion of oil sand containing a piece of metal to be rejected from the system 300 preventing the metal from damaging components in the slurry processing tower 50.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The invention claimed is:

1. A system for forming an oil sand slurry from mined oil sand, comprising:

a slurry preparation tower having a descending sequence of components for preparing the oil sand slurry without requiring a screen to screen out oversized lumps, comprising:

an intake opening through which mined oil sand enters the slurry preparation tower;

a first sizer device operative to comminute oil sand passing through the first sizer to a first upper size threshold;

a second sizer device operative to comminute oil sand passing through the second sizer to a second upper size threshold, wherein the second upper size threshold is less than the first upper size threshold; and a pump box for receiving oil sand that has passed through the second sizer and feeding it to a pump;

at least one conveyor, having a discharge end, for transporting mined oil sand to the slurry preparation tower;

a metal detector for detecting a piece of metal in the mined oil sand during the transport of the mined oil sand to the slurry preparation tower, and transmitting a signal; and a metal rejection device operative to, in response to the signal from the metal detector, reject a portion of mined oil sand containing the piece of metal before the portion of mined oil sand enters the slurry preparation tower.

2. The system of claim 1 wherein the slurry preparation tower includes at least one liquid outlet positioned in the slurry preparation tower to add a solvent to oil sand passing through the slurry preparation tower.

3. The system of claim 1 wherein a first liquid outlet is provided before the first sizer device to add the solvent to oil sand entering the first sizer and a second liquid outlet provided before the second sizer device to add the solvent to oil sand entering the second sizer.

4. The system of claim 1 wherein the first sizer comprises a plurality of horizontally spaced-apart rotating elements.

5. The system of claim 4 wherein each rotating element has a plurality of crusher teeth provided on an outer surface of the rotating elements.

6. The system of claim 1 wherein the second sizer is positioned directly below the first sizer so that substantially all of the oil sand that has passed through the first sizer drops onto the second sizer.

7. The system of claim 1 further comprising a mixing box positioned below the second sizer so that substantially all of the oil sand that has passed through the second sizer drops into the mixing box.

8. The system of claim 7 wherein the mixing box comprises a number of downwardly sloping shelves for mixing the oil sand and solvent as it passes through the mixing box.

9. The system of claim 1 further comprising a preliminary crusher before the slurry preparation tower to reduce the size of mined oil sand prior to transporting mined oil sand to the slurry preparation tower.

10. The system of claim 1 wherein the metal rejection device is positioned proximate the discharge end of the at least one conveyor and redirects the flow of oil sand that has been discharged from the at least one conveyor.

11. The system of claim 1 wherein an apron feeder is positioned below the discharge end of the at least one conveyor, the apron feeder having a first end positioned over the intake opening of the slurry preparation tower.

12. The system of claim 11 wherein the apron feeder has a second end positioned away from the intake opening of the slurry preparation tower and wherein the metal rejection device removes the portion of mined oil sand by temporarily reversing the direction of the apron feeder so that the portion of mined oil sand is discharged from the apron feeder from the second end of the apron feeder.

13. The system of claim 3 further comprising a third liquid outlet provided after the second sizer device.

14. A method of forming a pumpable oil sand slurry, the method comprising the steps of:

providing at least one conveyor for delivering the mined oil sand to a slurry preparation tower having a downwardly descending sequence of components for preparing the oil sand slurry without screening, the slurry preparation tower comprising a first sizer and a second sizer;

monitoring the mined oil sand being delivered by the at least one conveyor for a piece of metal and in response to locating the piece of metal, automatically removing a part of the mined oil sand containing the piece of metal before the part of the mined oil sand containing the piece of metal is delivered to the slurry preparation tower;

comminuting the mined oil sand in the first sizer to a first upper size threshold;

comminuting the oil sand that has passed through the first sizer in the second sizer to a second upper size threshold that is less than the first upper size threshold;

adding a solvent to the oil sand as it passes through the slurry processing tower; and pumping formed oil sand slurry out of the slurry preparation tower;

whereby substantially all of the mined oil sand entering the slurry preparation tower exists the slurry preparation tower as oil sand slurry.

15. The method of claim 14 further comprising comminuting the mined oil sand using a preliminary crusher to pre-crush the mined oil sand prior to monitoring the mined oil sand being delivered by the at least one conveyor for a piece of metal.

16. The method of claim 15 further comprising passing the oil sand slurry, that has passed through the second sizer, through a mixing box.

* * * * *